US006860258B2

(12) United States Patent
Farrell

(10) Patent No.: US 6,860,258 B2
(45) Date of Patent: Mar. 1, 2005

(54) PAINTBALL LOADER

(76) Inventor: Kenneth R. Farrell, 19202 - SE. 184th St., Renton, WA (US) 98058

( * ) Notice: Subject to any disclaimer, the term of this patent is extended or adjusted under 35 U.S.C. 154(b) by 66 days.

(21) Appl. No.: 10/386,850

(22) Filed: Mar. 11, 2003

(65) Prior Publication Data

US 2003/0168053 A1 Sep. 11, 2003

Related U.S. Application Data

(63) Continuation-in-part of application No. 10/206,013, filed on Jul. 26, 2002.

(60) Provisional application No. 60/363,450, filed on Mar. 11, 2002.

(51) Int. Cl.[7] ..... F41B 11/02

(52) U.S. Cl. ..... 124/51.1; 124/49

(58) Field of Search ..... 124/49, 51.1, 71–77

(56) References Cited

U.S. PATENT DOCUMENTS

| | | | | |
|---|---|---|---|---|
| 659,507 | A | | 10/1900 | Browning |
| 689,283 | A | | 12/1901 | Browning |
| 1,099,621 | A | | 6/1914 | Schildbach |
| 2,223,093 | A | | 11/1940 | Brewer |
| 2,278,589 | A | | 4/1942 | Rutherford |
| 2,288,891 | A | | 7/1942 | Dreyer |
| 2,476,232 | A | | 7/1949 | Williams |
| 2,581,505 | A | | 1/1952 | Wells |
| 2,592,858 | A | | 4/1952 | Clarkson |
| 2,594,185 | A | | 4/1952 | Lefever |
| 2,713,859 | A | | 7/1955 | Bradfield |
| 2,765,557 | A | | 10/1956 | Roper |
| 2,791,855 | A | | 5/1957 | Simmons |
| 3,103,212 | A | | 9/1963 | Merz |
| 3,125,821 | A | | 3/1964 | Ruger |
| 3,142,921 | A | | 8/1964 | Ruger |
| 3,547,095 | A | | 12/1970 | Vadas |
| 3,611,608 | A | | 10/1971 | Seiberling |
| 4,004,566 | A | | 1/1977 | Fischer |
| 4,012,859 | A | | 3/1977 | Johansson |
| 4,014,247 | A | | 3/1977 | Tollinger |
| 4,531,503 | A | * | 7/1985 | Shepherd ..... 124/76 |
| 4,821,442 | A | | 4/1989 | Bock |
| 4,856,217 | A | | 8/1989 | Benelli |
| 4,896,646 | A | * | 1/1990 | Kahelin et al. ..... 124/51.1 |
| 4,993,400 | A | | 2/1991 | Fitzwater |
| 5,148,619 | A | | 9/1992 | Badali |
| 5,673,679 | A | | 10/1997 | Walters |
| 5,722,383 | A | * | 3/1998 | Tippmann et al. ..... 124/76 |
| 5,758,444 | A | | 6/1998 | Ruger |
| 5,771,875 | A | | 6/1998 | Sullivan |
| 5,816,232 | A | * | 10/1998 | Bell ..... 124/51.1 |
| 5,947,100 | A | | 9/1999 | Anderson |
| 5,954,042 | A | | 9/1999 | Harvey |
| 6,109,252 | A | | 8/2000 | Stevens |
| 6,213,110 | B1 | * | 4/2001 | Christopher et al. ..... 124/51.1 |
| 6,305,367 | B1 | | 10/2001 | Kotsiopoulos |
| 6,347,621 | B1 | * | 2/2002 | Guthrie ..... 124/48 |
| 6,418,919 | B1 | * | 7/2002 | Perrone ..... 124/49 |
| 6,502,367 | B1 | * | 1/2003 | Sterner et al. ..... 53/370.6 |
| 6,644,293 | B2 | * | 11/2003 | Jong ..... 124/52 |
| 6,701,907 | B2 | * | 3/2004 | Christopher et al. ..... 124/48 |
| 2002/0117159 | A1 | * | 8/2002 | Kotsiopoulos et al. ..... 124/51.1 |
| 2003/0047175 | A1 | | 3/2003 | Farrell |

* cited by examiner

*Primary Examiner*—Jack Keith
*Assistant Examiner*—Troy Chambers

(57) ABSTRACT

A paintball gun loader. The loader is used in a closed-bolt paintball gun. The loader provides a paintball contact surface that moves in oscillating fashion in response to movement of the bolt to load individual paintballs into the gun while the gun loading port is open, which occurs as the gun cycles when fired. The loader includes a spring element that limits the force exerted on the paintball being loaded, even in case of a jam when the paintball contact surface is urged toward the paintball. In one embodiment, a pivotally mounted flexible lever arm having a paintball contact surface oscillates through an angular range of motion in response to a cam surface of the bolt engaging a cam follower on the the loader. In such embodiment, the cam follower is urged toward the cam surface of the bolt, which in turn biases the paintball contact surface toward an open, paintball receiving position.

18 Claims, 7 Drawing Sheets

20
36
42
PB1
PB2
100
54
212
246
232
210
242
200
194
220
132
140
138
178
170
206
22
204
152
202
162
46
28
120
118
186
166
156
116
110
126
122
148
146
50
112

20
36
54
212
PB2
100
112
50
232
238
220
148
200
194
170
110
166
186
116
22
162
126
110
122

PAINTBALL LOADER

RELATED PATENT APPLICATIONS

This patent application claims priority from prior U.S. Provisional Patent Application Ser. No. 60/363,450 filed on Mar. 11, 2002, entitled Paintball Loader, the disclosure of which is incorporated herein in its entirety by this reference. This patent application also claims priority from prior U.S. patent application Ser. No. 10/206,013, filed on Jul. 26, 2002, entitled Pneumatic Gun, the disclosure of which is incorporated herein in its entirety by this reference.

TECHNICAL FIELD

This invention is in the field of paintball guns. More particularly the invention relates to loaders for paintball guns, especially loaders which move to rapidly and sequentially load paintballs one after another.

BACKGROUND

Many types of paintball guns exist which propel paintballs by the release of compressed gas. More particularly, many styles of semiautomatic or full automatic paintball guns are available which automatically cycle after firing in order to quickly reload a paintball and thus prepare the gun to fire again. Most of the common paintball gun types utilize an external storage container, referred to as a hopper, to hold paintballs to be fed to the gun. From the hopper, paintballs travel via way of a paintball feed tube to a loading chamber configured for holding a paintball to be loaded. A loading port defines an aperture into the breach. The breach receives the paintball to be fired. A slidably translatable bolt opens the loading port for paintball loading, then pushes the paintball from the breech to the firing chamber.

In a paintball gun, the bolt is only one part of a bolt assembly that includes the bolt and the various gun elements that move with the bolt. Gun elements that make up the bolt assembly in a particular gun often include a piston that is induced to move in response to the urging of compressed gas as the gun cycles, and a connecting rod or other mechanical link that causes the bolt to move in response to the movement of the piston. The piston is typically located inside the gun frame, or in a cylinder mounted externally on the gun frame. However, the bolt assembly can include gun elements that move in a direction different from the bolt, or at a rate different than the bolt, but that cause movement of the bolt, or may otherwise be responsive to or connected with movement of the bolt.

In most paintball guns, the bolt itself is slidably translatable between a forward "bolt-closed" position and a rearward "bolt-open" position within a bolt chamber that extends longitudinally within the gun frame. Within the bolt chamber, a breech receives the loaded paintball that is to be fired. Adjacent the breech is a loading chamber, which is the location where the next paintball to be loaded into the breech resides until it is loaded through the loading port and into the breech. The loading chamber is commonly located immediately above the breech if the paintballs move downward, such as under the urging of gravity. However, the loading chamber may be located beside or below the breech if a suitable loader mechanism is provided for pushing paintballs toward the breech.

An opening through the wall of the bolt chamber defines a loading port through which a paintball passes as it moves from the loading chamber into the breech. When the bolt is in the forward position, the bolt closes the loading port.

When the bolt is in the rearward position, the loading port is open and the next paintball to be fired can move from the loading chamber, through the loading port, and into the breech. Movement of the bolt from the rearward position to the forward position serves to move the paintball forward from the breech to the firing chamber. The firing chamber is the location where the paintball resides when, as the gun is fired, compressed gas impinges on the paintball to propel it forward out of the gun.

Paintball guns which may most benefit from use of the present invention are either of a semiautomatic type or of a full automatic type. In either case, when the gun is fired it automatically cycles, reloading and recocking the gun. Thus, when the gun is fired, it cycles until returning to a state in which it is ready to fire again.

In general, paintball guns can be classified as either "open-bolt" or "closed-bolt", depending on the whether loading port is open, or is closed by the bolt, when the gun is ready to fire. When an open-bolt gun is ready to be fired, the bolt is in the rearward position so the loading port is open. The paintball to be fired is in the breech. The next paintball to load is prevented from moving into the breech by the paintball already in the breech, rather than by the bolt. When an open-bolt gun is fired, the bolt moves forward, closing the loading port and moving the paintball forward from the breech and into the firing chamber. After the bolt closes the loading port, compressed gas is released to propel the paintball forward from the gun. The bolt then returns back to the rearward position, opening the loading port to allow a new projectile to enter into the breech from the loading chamber. Thus it can be seen that when an open-bolt gun is fired, the gun cycles with the bolt first moving forward and then moving rearward.

When a closed-bolt paintball gun is ready to be fired, the bolt is already in the forward position, and the loading port is already closed. The paintball to be fired is already in the firing chamber forward of the bolt. When the gun is fired, compressed gas is released to impinge on the paintball in the firing chamber and propel it from the gun.

As this happens, or shortly thereafter, the bolt moves toward the rearward position and opens the loading port so that a new paintball can move from the loading chamber, through the loading port, and into the breech. Then the bolt moves forward, closing the loading port and moving the newly loaded paintball from the breech into the firing chamber. At that time, the gun is ready to be fired again. Thus it can be seen that when a closed-bolt gun is fired, the gun cycles with the bolt first moving rearward and then moving forward.

In closed-bolt guns, one way to decrease cycle times would be to shorten the period of time that the bolt stays rearward to keep the loading port open. However, a new paintball can move from the loading chamber, through the loading port, and into the breech only during the period of time the bolt is rearward. If the bolt returns forward too soon, it may catch a partially loaded paintball against the edge of the loading port, jamming the gun and potentially breaking the paintball.

Thus, it can be seen that a need still exists for a loader which could operate in close synchronization with the movement of the bolt in a closed-bolt gun, in order to urge a paintball from the loading chamber into the breech in a manner that would minimize the time that the loading port need be open.

And, occasionally a paintball to be loaded does not move far enough into the loading chamber that it is in a proper position to be pushed through the loading port, yet it is sufficiently into the loading chamber that it may be contacted by a loader and thus jammed against some part, such as the gun frame or feed tube, as the loader urges it toward the breech. When such a situation occurs, it would be advantageous to provide a loader that would urge the paintball toward the breech with a force sufficiently limited so that the paintball would not be damaged or broken.

Thus, a new paintball loader for closed-bolt paintball guns which provides the desirable features of (A) urging a paintball to move from the loading chamber and into the breech in response to and in close synchronization with the movement of the bolt assembly, and of (B) urging the paintball to move rapidly but with an urging force that is not so great as to damage a paintball that is not yet quite in position to move through the loading port, can be readily appreciated.

BRIEF DESCRIPTION OF THE DRAWING

In order to enable the reader to attain a more complete appreciation of the invention, and of the novel features and advantages thereof, attention is directed to the following detailed description when considered in connection with the accompanying drawings, wherein.

The foregoing figures, being merely exemplary, contain various elements that may be present or omitted from actual implementations or final configurations depending upon the circumstances. An attempt has been made to draw the figures in a way that illustrates at least those elements that are significant for an understanding of the various embodiments and aspects of the invention. However, various other elements of the paintball loader described herein, especially as applied for different structural configurations and functional components of the many paintball guns, may be utilized in order to provide a rapid and reliable paintball loader, and still be within the overall teachings of the present invention, and the legal equivalents thereof.

DETAILED DESCRIPTION

Figure 1:
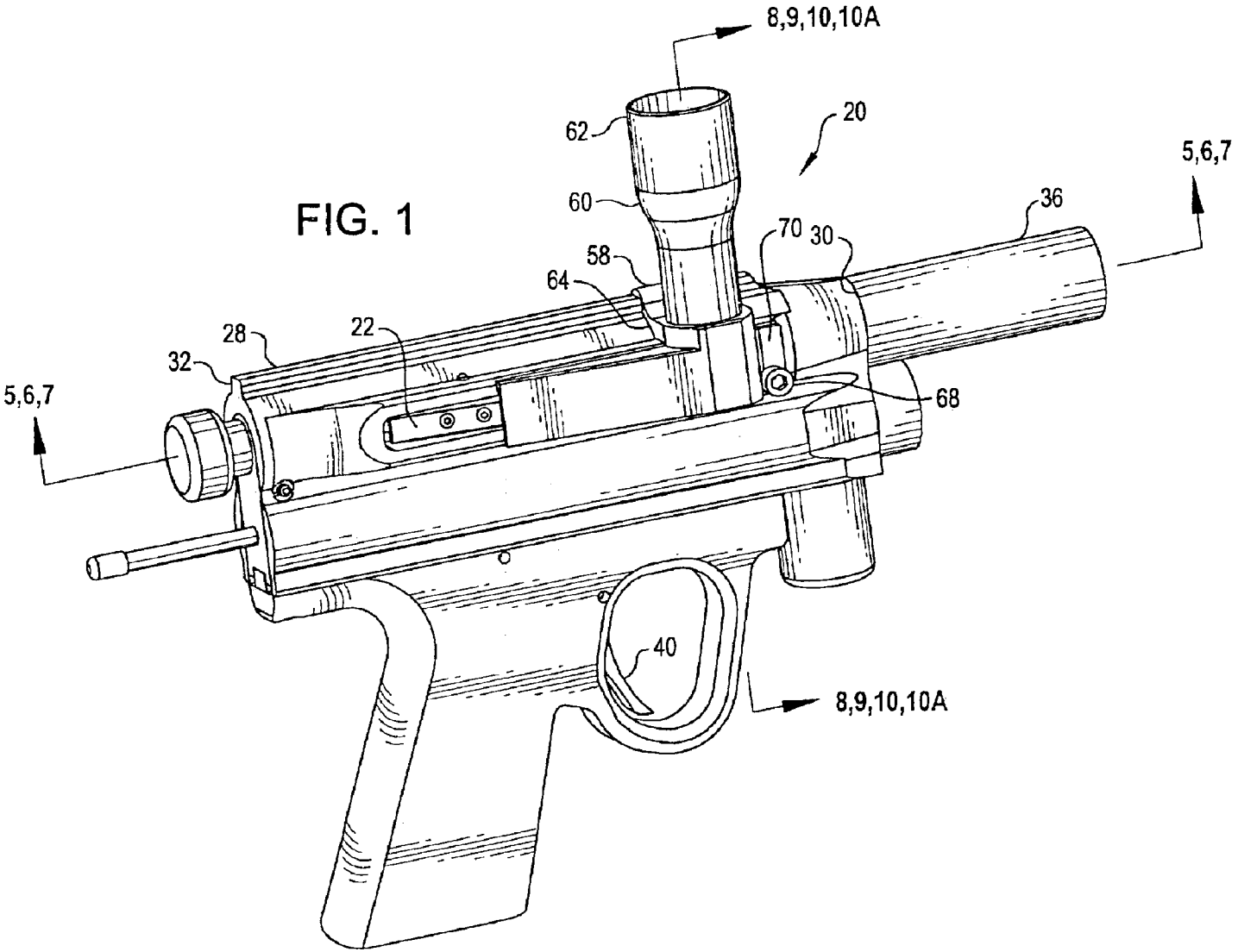
FIG. 1 is an external perspective view of an exemplary closed-bolt paintball gun incorporating a loader which embodies principles of the present invention; the gun has a user-actuable trigger, a frame with a rearward end and a forward end, a barrel attached to the forward end of the frame, and a pivotable paintball feed tube and feed tube support with an integrally attached loader cover shown in the closed, ready-to-fire position.
Figure 2:
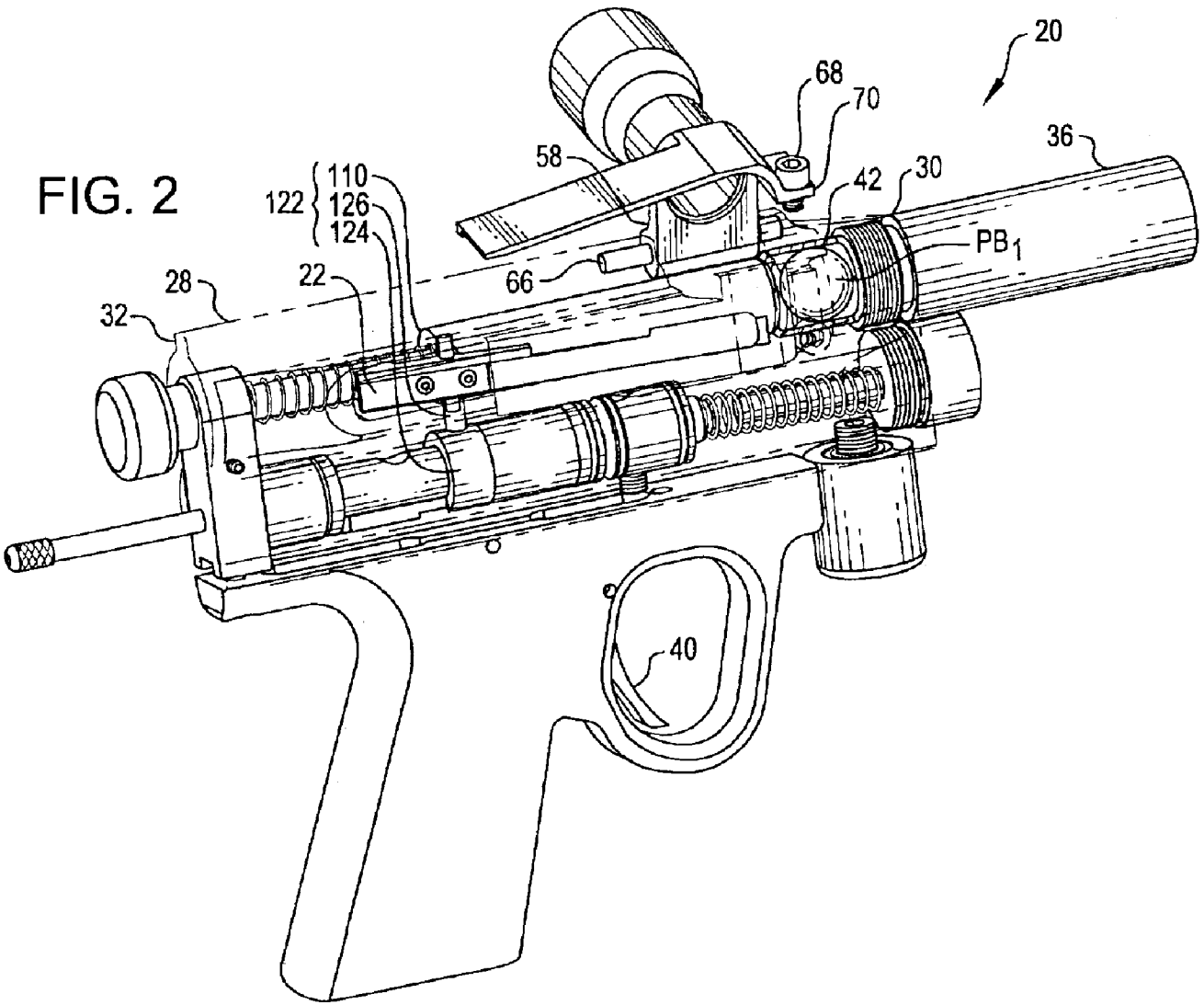
FIG. 2 is a perspective view of the gun just shown in FIG. 1, but now showing a portion of the gun frame in phantom view in order to show elements of the bolt assembly; also the paintball feed tube, feed tube support and loader cover pivoted to an open, inspection and service position.

Attention is directed to FIGS. 1 and 2, which provide a perspective view of a paintball gun 20 which incorporates therein one embodiment of a paintball loader 22 as taught herein. To illustrate one structural embodiment for paintball loader 22, and for description of a method for employing the same in a paintball gun, loader 22 is incorporated within an exemplary semi-automatic closed-bolt paintball gun 20. Thus, when gun 20 is fired it automatically cycles to reload and recock, thereby returning the gun 20 to an initial ready-to-fire condition.

Loader 22 serves to urge paintballs PB individually into the breech 50 of gun 20 as gun 20 cycles when fired. Loader 22 provides oscillating paintball contact surface 212 that initially resides in an open, paintball receiving position (see FIG. 5) to accommodate the introduction into the gun loading chamber 54 a paintball ($PB_2$ in FIG. 5) to be loaded. When gun 20 is fired, a gun bolt assembly 122 cycles. The paintball contact surface 212 travels in response to the cycling of the bolt assembly 122, first in an inward direction toward breach 50 to load the paintball PB into the gun breech 50, and then outward to return to the initial open position (illustrated in FIG. 5) for accommodating another paintball PB into the loading chamber 54. A cam 116 on the bolt assembly 122 and a cam follower 186 on the loader 22 engage and disengage to couple the movement of the loader 22 to the movement of the bolt assembly 122, thereby ensuring that the loader 22 acts in close synchronization with the cycling of the bolt assembly 122. The motion of the bolt assembly 122 provides the energy to move the paintball contact surface 212.

Components of gun 20 include a gun frame 28 having a forward end 30 and a rearward end 32, a barrel 36, and a user-actuable trigger 40. Shown in FIG. 2 is a paintball $PB_1$, in position in a firing chamber portion 42 of gun 20 to be propelled forward through barrel 36 when gun 20 is fired.

Figure 7:
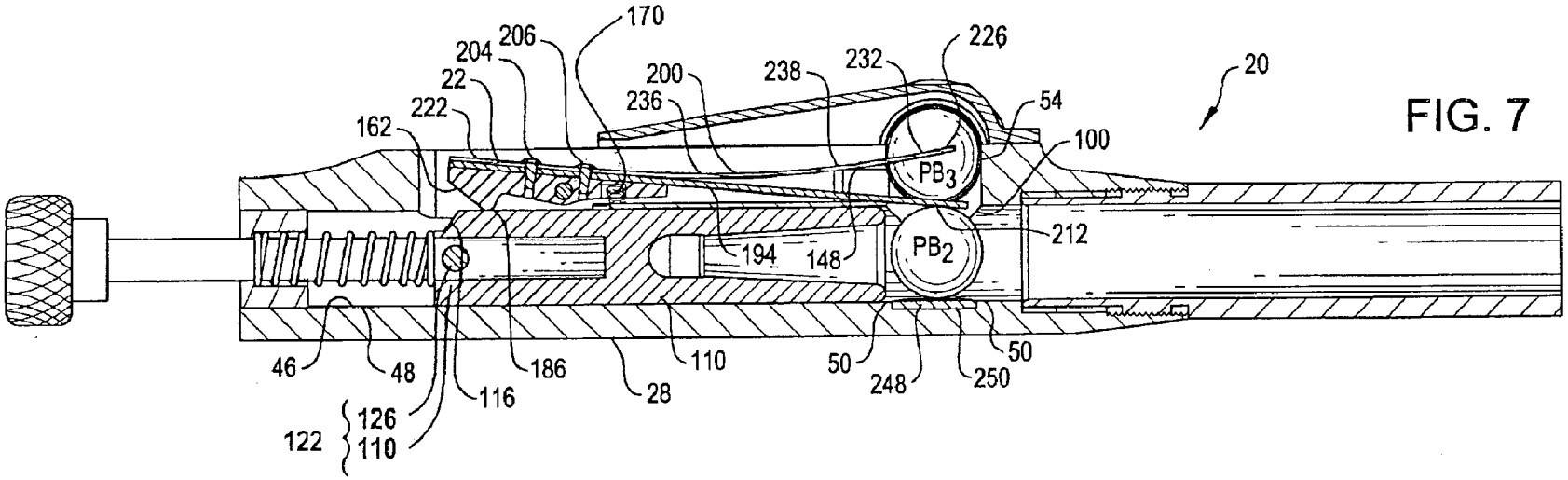
FIG. 7 is a horizontal cross-sectional view, similar to the view just provided in FIG. 5, now showing the bolt fully rearward, the loading port fully open, and the paintball formerly in the loading chamber now residing in the breech.

Referring to FIG. 7, extending longitudinally within gun frame 28 is a bolt chamber 46 defined by a bolt chamber sidewall 48. A breech portion 50 of bolt chamber 46 serves to receive and contain a just-loaded paintball, exemplified in FIG. 7 by paintball $PB_2$.

Figure 4:
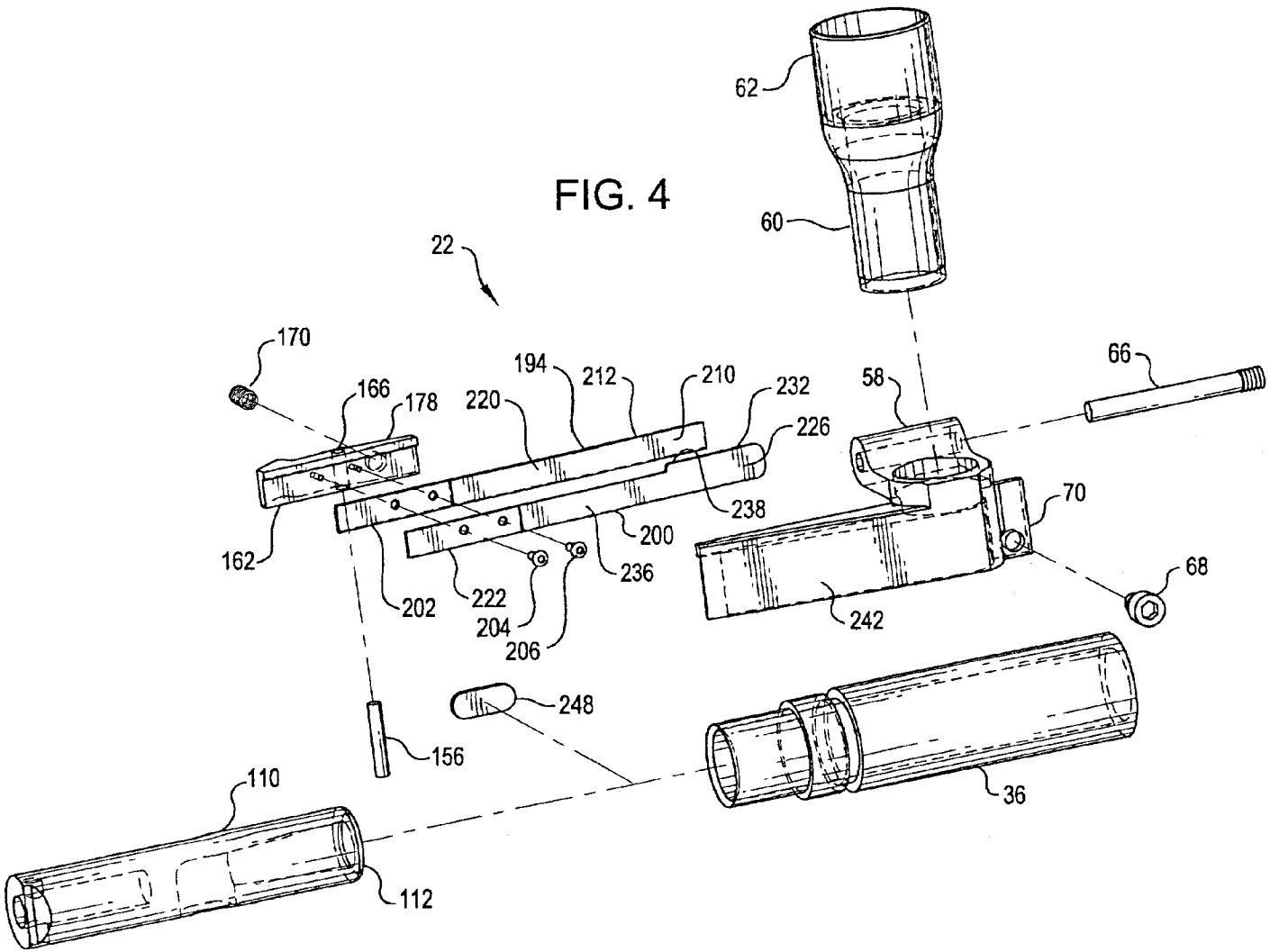
FIG. 4 is an exploded perspective view of the loader provided on the gun illustrated in FIG. 1, showing in detail components of one embodiment of a loader, including the pivot block pivot pin 456, the pivot block with cam follower, a bolt having a cam surface, a lever arm having a paintball contact surface, a stop arm having a paintball stop, a paintball feed tube, a paintball feed tube support with integral loader cover, and a feed tube support hinge pin.
Figure 8:
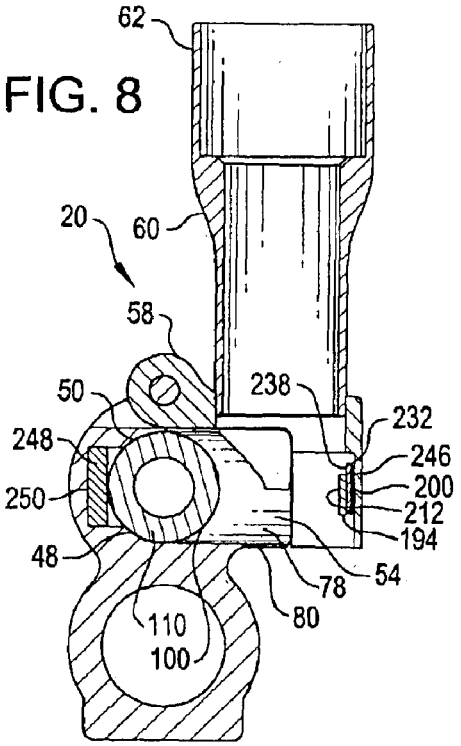
FIG. 8 is a cross-sectional view taken looking forward at line 8—8 of FIG. 1, showing the feed tube, feed tube support, loader cover, breech and loading chamber of the gun, with the gun bolt in the bolt-closed position, but without any paintballs present in order to better show structural details of the loader and nearby gun components.
Figure 9:
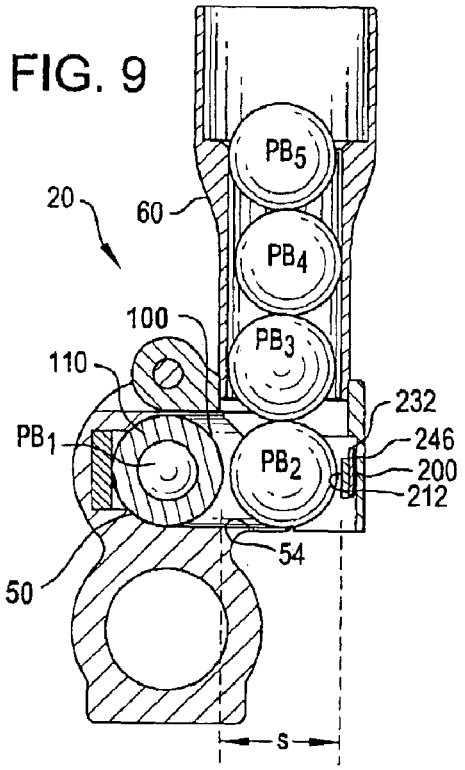
FIG. 9 is a cross-sectional view, similar to the view just provided in FIG. 8, now showing a paintball in the loading chamber ready to be loaded, and showing a central portion of the paintball forward of the bolt; the gun is in the same operating state as previously shown in FIG. 5.

Gun 20 has a loading chamber 54 located adjacent to and laterally outward from breech 50 for receiving and containing the next paintball PB to be loaded. Referring to FIGS. 1, 4 and 8, gun 20 has a feed tube support 58, and a paintball feed tube 60 affixed thereon. Feed tube 60 is adapted at an upper feed tube end 62 to attach to an external paintball supply hopper (not shown). Feed tube 60 provides a paintball feed channel for sequentially receiving paintballs from the hopper and conducting them downward into loading chamber 54 to await loading. FIG. 9 shows, by way of example, paintball $PB_2$ in loading chamber 54, and paintballs $PB_3$, $PB_4$, and $PB_5$ in position to pass downward through feed tube 60 toward loading chamber 54.

Figure 3:
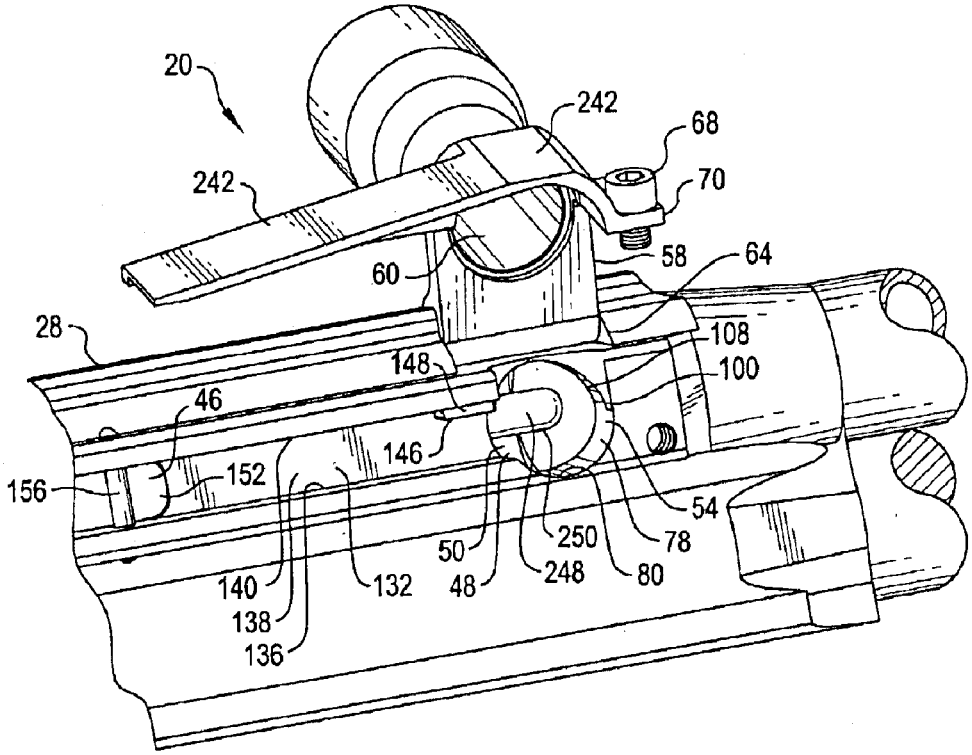
FIG. 3 is a partially broken away perspective view of a portion of the gun provided in FIGS. 1 and 2, showing the feed tube support, feed tube and loader cover pivoted to an open position, and with the loader pivot block and lever arm (see FIG. 4) removed to reveal the loading port and the loader mounting slot which is cut longitudinally into the gun frame to accommodate the loader pivot block, lever arm, and stop arm.

Referring to FIGS. 1, 2 and 3, feed tube support 58 is pivotably mounted in a hinge slot 64 cut into gun frame 28. A removable hinge pin 66 serves to pivotably secure feed tube support 58 within hinge slot 64. In this embodiment, a retaining screw 68 secures feed tube support 58 in a closed gun-operating position, via flange 70 extending downward from feed tube support 58. In FIGS. 2 and 3, the feed tube support 58 is shown pivoted to an open position, as might be desirable when gun 20 is being cleaned.

Attention is directed to FIGS. 3 and 8, where loading chamber 54 is shown defined in part by a loading chamber wall 78. In this embodiment, chamber wall 78 includes a bottom portion 80 that serves to arrest the downward motion of a paintball entering loading chamber 54 from feed tube 60. In this embodiment, chamber wall 78 and its bottom portion 80 serve to arrest vertical motion of the paintball PB prior to loading of the paintball PB into the breach 50 via a substantially horizontal motion.

A loading port 100, defined by a loading port edge 108 best seen in FIG. 3, defines an aperture which penetrates bolt chamber sidewall 48 to provide communication from loading chamber 54 to breech 50. Loading port 100 when open accommodates the passage therethrough of a paintball PB from loading chamber 54 into breech 50. For example, in FIGS. 7 and 10, breach 50 is seen to contain paintball $PB_2$ that has just been loaded from loading chamber 54.

Figure 5:
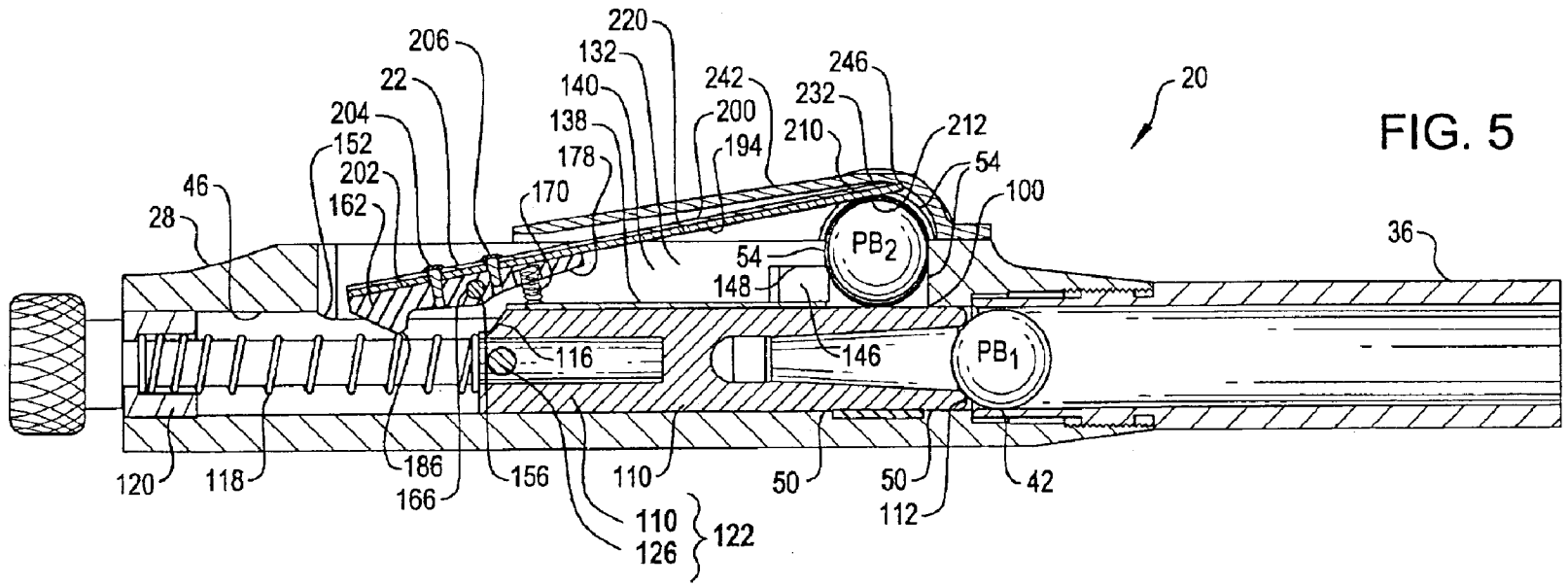
FIG. 5 is a horizontal cross-sectional view through the loading chamber of the gun provided in FIG. 1, taken looking up at line 5—5 of FIG. 1, showing the gun as it appears both when ready to be fired and just after firing, with a paintball forward of the bolt in position ready to be propelled from the gun, with the loading port closed by the bolt, and with a paintball in the loading chamber ready for loading into the breech when the bolt moves rearward to open the loading port as the gun cycles.

Referring to FIGS. 2 and 5, within bolt chamber 46 is a bolt 110 with a forward end 112. Provided on bolt 110 is a rearwardly-directed cam 116. A bolt spring 118 captive between bolt 110 and a rear frame plug 120 serves to urge bolt 110 forward toward the bolt-closed position illustrated in FIG. 5. Bolt 110 is part of a bolt assembly 122 which in this embodiment also includes a recock piston 124 (see FIG. 2) and a connecting rod 126. As will be known to one skilled in the art, other closed-bolt paintball gun types in which the present invention may be utilized and to which this specification is directed may incorporate bolt assemblies which include additional or different elements than are specified in exemplary gun 20 described herein. Accordingly, cam 116, which is provided in this embodiment on bolt 110, could be provided elsewhere on bolt assembly 122, for example on recock piston 124, and thus be a part of the bolt assembly as described and claimed herein. In this regard, it should be understood that the elements of bolt assembly 122 move together. That is, bolt assembly 122 translates reciprocally within gun 20 as bolt 110 translates reciprocally within bolt chamber 46. Thus, the bolt assembly 122 cycles in gun 20 when the gun 20 is fired, moving together from a bolt-closed position where bolt assembly 122 and bolt 110 are forward and loading port 100 is closed by bolt 110 (as illustrated in FIG. 5), to a bolt-open position where bolt assembly 122 and bolt 110 are rearward and loading port 100 is open (as illustrated in FIG. 7). The bolt assembly 122 returns forward to the initial bolt-closed position seen previously in FIG. 5 to place gun 20 in a ready-to-fire state. Thus, when gun 20 is ready to fire, bolt assembly 122 and bolt 110 are forward and reside in the bolt-closed position.

Referring to FIGS. 3 and 5, extending rearwardly from loading chamber 54 on the exterior of gun frame 28 is a loader mounting slot 132 defined by a lower slot wall 136, an inner slot wall 138, and an upper slot wall 140. In this embodiment, loader mounting slot 132 is a generally U-shaped trough. On upper wall 140 of loader mounting slot 132 near loading chamber 54, is a stop boss 146 providing at a predetermined location an outwardly-directed boss contact face 148. Penetrating through inner slot wall 138 to provide access to bolt chamber 46 is a bolt access opening 152. A pivot pin 156 extends across slot 132 and is removably fixed to gun frame 28. In FIG. 3, various components of loader 22 have been removed to more clearly show loading port 100, pivot pin 156, and bolt access opening 152.

Referring to FIGS. 4 and 5, loader 22 includes a pivot block 162. Pivot block 162 is penetrated by a pivot pin bore 166 that provides a pivot-block rotation axis. Pivot pin 156 fits through bore 166 in a manner that permits pivot block 162 to securely rotate cyclically angularly around the pivot-block rotation axis which provides oscillatory motion between a pivot-block open position shown in FIG. 5 and a pivot-block loading position shown in FIGS. 6 and 7.

Returning to FIGS. 4 and 5, loader 22 includes a return spring 170. Return spring 170 is captive between a forward portion 178 of pivot block 162 and inner slot wall 138. Return spring 170 serves to urge forward portion 178 of pivot block 162 away from wall 138, thereby urging pivot block 162 to rotate counterclockwise (as viewed from below) toward the pivot-block open position.

Figure 6:
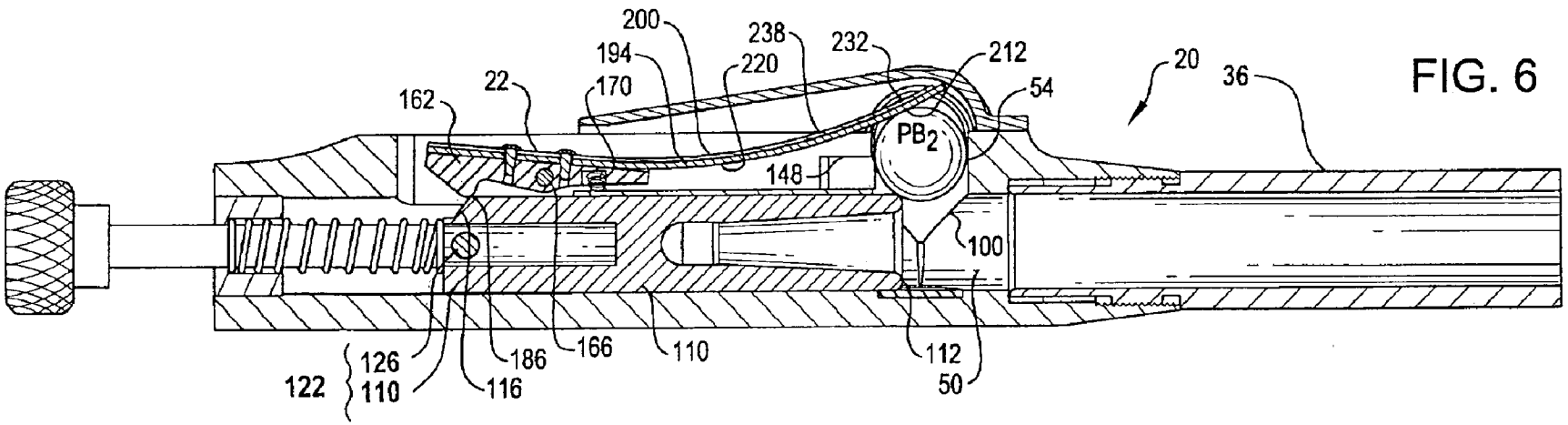
FIG. 6 is a horizontal cross-sectional view, similar to the view just provided in FIG. 5, but now showing the bolt moving toward the rear of the gun, and with the paintball in the loading chamber now being urged through the loading port and toward the breech.

Referring to FIG. 5, in this embodiment a forwardly-directed cam follower portion 186 of pivot block 162 extends inward to fit through bolt access opening 152. Referring to FIG. 6, as bolt assembly 122 and bolt 110 begin to cycle, translating rearward from the bolt-closed position toward the bolt-open position, cam 116 engages cam follower 186 to urge cam follower 186 outward. In this embodiment cam follower 186 is rearward of pivot pin bore 166, so that outward movement of cam follower 186 results in pivot block 162 rotating clockwise (as viewed from below), toward the pivot-block loading position.

As bolt assembly 122 subsequently returns forward to complete the cycle, cam 116 and cam follower 186 disengage, allowing return spring 170 to urge cam follower 186 to move inward and pivot block 162 to rotate counter-clockwise toward the pivot-block open position seen in FIG. 5. Thus pivot block 162 is seen to move cyclically angularly, starting in the open position and returning to the open position, thus oscillating in response to the cycling of bolt assembly 122.

Referring to FIGS. 4, 5 and 6, loader 22 includes a lever arm 194 and, in this embodiment, a stop arm 200. In this embodiment lever arm 194 is removably attached to pivot block 162, and includes a proximal portion 202 removably affixed to pivot block 162 by lever arm screws 204 and 206, a distal portion 210 providing a paintball contact surface 212 thereon, and a flexible elastic spring portion 220 between proximal portion 202 and paintball contact surface 212. Although the lever arm 194 in this embodiment is separable from the pivot block 162, it will be appreciated by one skilled in the art that the teaching of the present invention can also be achieved by use of a loader that combines a pivot block and a lever arm incorporating an elastic spring portion in a single unitary structure, for example by injection molding or other forming or machining process, and such an embodiment is considered within the scope of applicable claims herein.

Lever arm 194 extends forward from pivot block 162 to place paintball contact surface 212 in a position for movement inward and outward through loading chamber 54, and thus engageable on a paintball PB in loading chamber 54. When pivot block 162 is in the pivot-block open position as shown in FIG. 5, paintball contact surface 212 is outward in a contact-surface open position.

Lever arm 194 operates as a lever to urge a paintball PB from loading chamber 54 and toward breech 50 as pivot block 162 rotates in response to rearward translation of bolt assembly 122. Lever arm 194 extends forward from pivot block 162, so rotation of pivot block 162 toward the pivot-block loading position in response to rearward translation of bolt assembly 122 causes paintball contact surface 212 on lever arm 194 to be urged inward, toward breech 50, as shown in FIG. 6.

Referring further to FIGS. 4, and 5, the size and shape of paintball contact surface 212, the pivotal mounting of pivot block 162 to gun frame 28, and the length of extension of lever arm 194 from pivot block 162 toward loading chamber 54 to locate the position of paintball contact surface 212, are mutually established in order to achieve two objectives in the design. First, when paintball contact surface 212 is in the contact-surface open position as shown in FIG. 9, sufficient space S is provided between paintball contact surface 212 and breech 50 to accommodate the entrance of a paintball into loading chamber 54 from feed tube 60. Note that in FIG. 9, breech 50 is filled by bolt 110 closing off loading port 100. Second, paintball contact surface 212 is sized, shaped, and positioned in a location suitable to engage the paintball in loading chamber 54, and to urge the paintball toward and into breech 50, as pivot block 162 pivots to the pivot-block loading position. For example, in FIGS. 5 and 9, paintball $PB_2$ now resides in the loading chamber 54, awaiting engagement by the paintball contact surface 212, which is properly positioned to move, when actuated, the paintball $PB_2$ into the breach 50.

Paintball contact surface 212, as well as pivot block 162, oscillate in response to the cycling of bolt assembly 122 when gun 20 is fired. Referring to FIG. 5, when gun 20 is ready to fire, bolt assembly 122 resides forward in the bolt-closed position. Cam 116 and cam follower 186 are disengaged, so that return spring 170 urges pivot block 162 to the pivot-block open position. With pivot block 162 residing in the pivot-block open position, paintball contact surface 212 resides in the contact-surface open position, and a paintball to be loaded can enter into loading chamber 54.

Referring to FIG. 7, when gun 20 is fired and bolt assembly 122 begins to cycle by moving rearward to the bolt-open position, cam 11 6 and cam follower 186 engage. In response, pivot block 162 pivots angularly toward the pivot-block loading position, and paintball contact surface 212 moves inward toward breech 50, first moving inward to engage the paintball in loading chamber 54, and then continuing to move inward toward and/or through loading port 100 to urge the paintball through loading port 100 and into breech 50.

Then, as bolt assembly 122 returns forward to the bolt-closed position, cam 116 and cam follower 186 disengage. In response, pivot block 162 is urged by return spring 170 angularly back to the pivot-block open position, and paintball contact surface 212 is thus returned outward to the contact-surface open position shown in FIG. 5. In the contact-surface open position, the next paintball moves into loading chamber 54 (where paintball $PB_2$ was shown in FIG. 5) and thus is in position to be loaded into breech 50 the next time gun 20 is fired and bolt assembly 122 cycles.

Figure 10:
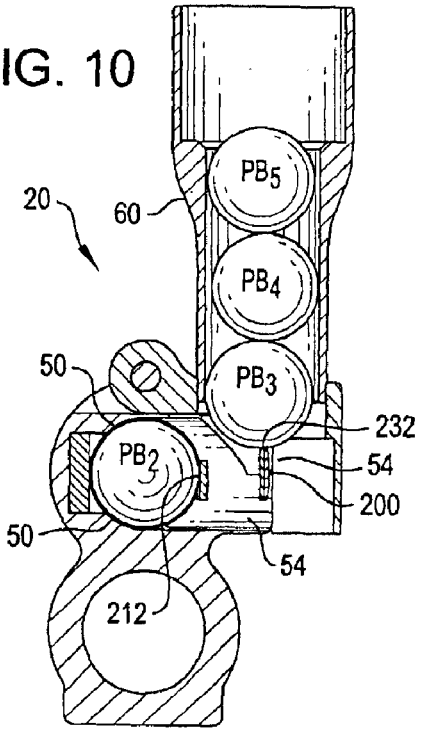
FIG. 10 is a cross-sectional view, similar to the view just provided in FIG. 8, now showing the gun in the same operating state as first illustrated in FIG. 7, with the paintball formerly in the loading chamber now residing in the breech, and the next paintball to load temporarily stopped from fully descending from the loader feed tube into the loading chamber by the ball stop surface of the loader stop arm.
Figure 10A:
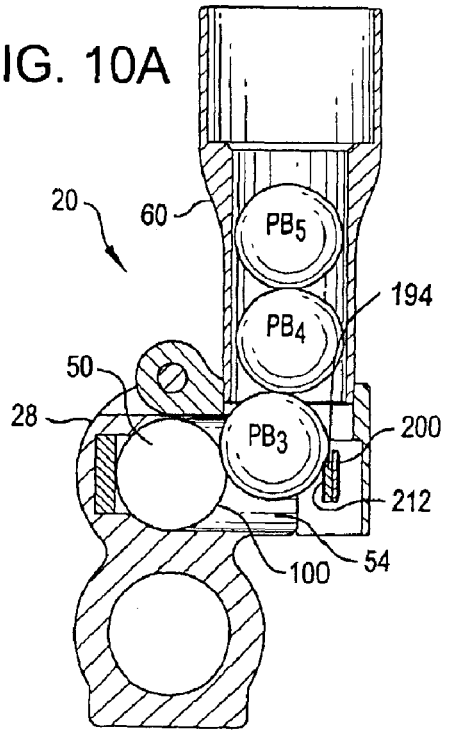
FIG. 10A is a cross-sectional view, similar to the view just provided in FIG. 10, but with the paintball failing to pass through the loading port and into the breech because the paintball was not far enough into the loading chamber before being urged toward the breech by the loader, with the result that the paintball has jammed against the feed tube.

Attention is now directed to FIGS. 6 and 10A. The location of the elements making up loader 22, and the location of cam 116 on bolt 110, can be provided in a predetermined arrangement and configuration so that paintball contact surface 212 urges a paintball toward breech 50 before loading port 100 is fully open, as is illustrated in FIG. 6. But, as shown in FIG. 10A, when paintball contact surface 212 moves inward through loading chamber 54 and toward breech 50 to load a paintball PB, occasionally the paintball to be loaded may not have moved far enough into loading chamber 54 that it is in position to be pushed through loading port 100. If it is not in far enough, a paintball such as $PB_3$ may be jammed against some portion of gun frame 28 or feed tube 60 by the moving contact surface 212. In the design provided in FIGS. 5, 6, 7, and 10A, the lever arm 194 is sufficiently flexible that the force provided by contract surface 212 against paintball $PB_3$ does not fracture $PB_3$. Thus, in one embodiment, the cam 116, the cam follower 186, pivot block 162, and lever arm 194 are sized, shaped, and positioned, and lever arm spring portion is 220 is provided with an appropriate stiffness, so that when paintball contact surface 212 moves inward toward breech 50 to load a paintball, paintball contact surface 212 exerts a force that is (1) sufficient, if a paintball is in position to move through loading port 100, to quickly move the paintball through loading port 100 while loading port 100 is open, and (2) not so great as to damage a paintball in the event that the paintball jams, or is urged toward breech 50 before loading port 100 fully opens.

Referring to FIGS. 4, 7, and 8, in one embodiment a loader 22 includes a paintball stop arm 200 secured to pivot block 162, as well as the lever arm 194. Stop arm 200 includes a stop arm proximal portion 222 that is removably affixed to pivot block 162 by lever arm screws 204 and 206, a stop arm distal portion 226 having an upwardly directed ball stop surface 232 thereon, and a flexible elastic stop arm portion 236 extending between proximal portion 222 and distal portion 226. Also on stop arm 200 is an inwardly directed stop boss engagement surface 238 engageable against boss contact face 148. Stop arm 200 is affixed to pivot block 162 to the exterior, i.e., angularly outward, of lever arm 194.

When paintball contact surface 212 is outward in the contact-open position as illustrated in FIGS. 5 and 9, ball stop surface 232 is held outward in a ball-stop-open position. When pivot block 162 rotates to the pivot-block loading position, and lever arm 194 is required to flex to accommodate a paintball not yet able to move from loading chamber 54 into breech 50, as is illustrated in FIG. 6, both lever arm 194 and stop arm 200 flex, thus relieving force against the paintball $PB_2$ shown in FIG. 6. When paintball contact surface 212 moves inward toward breech 50, stop arm 200 and ball stop surface 232 follow along until boss engagement surface 238 and boss contact face 148 engage as illustrated in FIG. 7. The engagement of surface 238 with boss contact face 148 arrests the inward motion of stop arm 200 and its ball stop surface 232 at a ball-stop-arrest position as illustrated in FIGS. 7 and 10.

The location of the ball-stop-arrest position, and the size, shape and orientation of ball stop surface 232, are predetermined so that when ball stop surface 232 is in the ball-stop-arrest position, ball stop surface 232 is engageable with a new paintball moving from feed tube 60 toward loading chamber 54 (for example, paintball $PB_3$ in FIGS. 7 and 10) and prevents this paintball $PB_3$ from moving far enough into loading chamber 54 so as to interfere with the subsequent return of lever arm 194 and its paintball contact surface 212 outward to the contact-surface open position. Thus, ball stop arm 200 beneficially serves to reduce the chance that a paintball moving into loading chamber 54 will prevent the return of paintball contact surface 212 to the contact-surface open position after loading a paintball into breech 50.

Referring to FIGS. 3 and 4, a loader cover 242 extends rearward and downward from feed tube support 58 to protect loading chamber 54 and loader 22 against dirt and debris. In general, loader cover 242 can take any convenient form or shape that does not interfere with the functioning of the elements of loader 22, or with paintballs traveling from feed tube 60, through loading chamber 54 and into breech 50.

Referring to the embodiment illustrated in FIG. 5, within the interior of loader cover portion 242 is an inwardly-directed arm motion stop 246 engageable with lever arm 194, and with stop arm 200 if provided. As pivot block 162 rotates in response to the urging of return spring 170, motion stop 246 serves to limit outward motion of paintball contact surface 212 at the contact-surface open position, and via lever arm 196, the counterclockwise rotation of pivot-block 162 to the pivot-block open position. Although loader cover portion 242 provides a convenient place to locate a stop for limiting the outward motion of paintball contact surface 212, it will be apparent to one skilled in the art that the teaching herein can be practiced using a variety of alternative engageable stop surfaces to limit the outward motion of lever arm 196 and its paintball contact surface 212.

A variety of flexible elastic materials, such as by way of example but not of limitation, plastic, fiberglass-reinforced epoxy, carbon fiber reinforced composite, or spring-tempered metal, can be utilized for the lever arm 194 and for the stop arm 200. The two arms can be, but need not be, provided in the same material. Likewise, the two arms can be, but need not be, provided with the same stiffness, i.e., bending capability to provide a temporarily arcuate shape (see FIGS. 6 and 7) for the lever arm 194 or stop arm 200. Depending on the specific operating characteristics of a gun designed for use with the present invention, and in particular the length of time the bolt assembly spends in the rearward position so that the loading port is open when the gun cycles, a wide range of stiffness values may be appropriate.

In one test, successful loader 22 operation was achieved using a lever arm 194 constructed of 0.036 in. thick fiberglass-reinforced epoxy material of a type commonly used for electronic printed circuit boards to provide a force of about 1 lb. against a paintball PB in the loading chamber when the lever arm 194 was fully flexed as illustrated in FIG. 6. The stop arm 200 in that test was constructed of similar material, but thinner and hence less, and provided about 2 oz. of force when flexed as illustrated in FIG. 6. Other tests demonstrated that force values considerably higher or lower than those values could also be made to work.

Referring to FIGS. 3, 7, and 8, in one embodiment a resilient paintball shock buffer 248 is fixed within a complementary pocket 250 in bolt chamber sidewall 48 opposite loading port 100. Buffer 248 serves to absorb momentum of a paintball PB moving into breech 50, thereby beneficially reducing the risk of paintball breakage within gun 20 and allowing more fragile paintballs to be loaded without breaking.

Now, the operation of loader 22 will be further described, first by reference to FIGS. 5 and 9, which show gun 20 as it appears when ready to fire (and also as it still appears very shortly after the initiation of firing). A later operating state of gun 20 during cycling after firing is shown in FIG. 6, and an even later operating state is shown in FIGS. 7 and 10.

Referring to FIGS. 5 and 9, a paintball $PB_1$ is in firing chamber 42 forward of bolt 110, ready to be propelled forward through barrel 36. Bolt assembly 122 is in the forward bolt-closed position, with bolt 110 closing off loading port 100. Cam 116 on bolt 110 is forward of and disengaged from cam follower 186, so that return spring 170 has urged pivot block 162 to the pivot-block-open position, and has urged the paintball contact surface 212 on lever arm 194 to the contact-surface open position. With paintball contact surface 212 in the contact-surface open position, the next paintball $PB_2$ in succession to load has entered into loading chamber 54.

Referring to FIG. 2, when gun 20 is fired, compressed gas is released. One portion of the released gas acts to propel paintball $PB_1$ forward from the gun. Another portion initiates cycling of gun 20 by urging recock piston 124 rearward. Bolt 110 is constrained by connecting rod 126 to translate with piston 124, and thus also moves rearward.

Referring to FIG. 6, as gun 20 cycles from the ready-to-fire operating state, the bolt assembly 122 moves rearward from the bolt-closed position. During this process, cam 116 on bolt assembly 122 moves rearward and engages cam follower 186. Cam follower 186 moves angularly outward in response, causing pivot block 162 to rotate clockwise (as viewed from the bottom) toward the pivot-block loading position. As pivot block 162 moves clockwise, paintball contact surface 212 is urged by lever arm 194 inward toward breech 50, to first engage paintball $PB_2$ in loading chamber 54, and to then urge paintball $PB_2$ toward breech 50.

In this embodiment, cam 116 is positioned to engage cam follower 186, and to thereby move pivot block 162 to the pivot-block loading position, before loading port 100 is fully opened as forward end 112 of bolt 110 moves rearward past loading port 100. As a result, movement of paintball $PB_2$ toward breech 50 is initially arrested by bolt 110, since bolt 110 is still partially blocking loading port 100. This operating state is illustrated in FIG. 6, which shows gun 20 shortly after firing, with the gun 20 starting to cycle, and where paintball $PB_1$ has been propelled forward through barrel 36 and thus is no longer visible.

While movement of paintball $PB_2$ into breech 50 is stopped by contact with bolt 110, the continued rotation of pivot block 162 in response to cam 116 as it continues to move past cam follower 186 causes spring portion 220 of lever arm 194 to flex as illustrated in FIG. 6. Such flexion stores energy in lever arm 194, and also serves to limit the force exerted against paintball $PB_2$ to an amount that is not likely to damage paintball $PB_2$ while it is being loaded. As earlier discussed and as illustrated in FIG. 10A, this force-limitation capability of lever arm 194 also serves to limit to a safe level the force exerted on a paintball that has not yet fully moved into loading chamber 54 when the urging toward breech 50 starts, so that the paintball instead of moving through loading port 100 is jammed against some portion of gun frame 28 or feed tube 60.

As cycling continues, bolt assembly 122 continues rearward toward the bolt-open position shown in FIG. 7. The energy stored in lever arm 194 helps ensure that paintball $PB_2$ is immediately urged through loading port 100 and into breech 50 as soon as bolt assembly 122 moves sufficiently rearward to permit passage therethrough, thus beneficially reducing the amount of time that bolt assembly 122 must be in the bolt-open position in order to allow a paintball to load. In this embodiment, as paintball $PB_2$ moves fully into breech 50, excess momentum of paintball $PB_2$ is absorbed by buffer 248.

Stop arm 200 initially moves along with lever arm 194 as pivot block 162 rotates, and ball stop surface 232 initially moves inward toward breech 50 along with paintball contact surface 212. Movement of ball stop surface 232 toward breech 50 is halted at the ball-stop-arrest position, as illustrated in FIGS. 7 and 10, by boss engagement surface 238 engaging with boss contact face 148. With ball stop surface 232 now in the ball-stop-arrest position the next ball to be loaded, paintball $PB_3$ in these illustrations, is prevented from moving so far into loading chamber 54 that it impedes the subsequent return of lever arm 194 and its paintball contact surface 212 from the paintball loading position shown in FIG. 7 to the open position shown in FIG. 5.

Cycling of gun 20 finishes with bolt assembly 122 returning forward in response to the urging of bolt spring 118 to the bolt-closed position seen previously in FIG. 5, which would move paintball $PB_2$ forward from breech 50 into the firing chamber 42, in the same position as shown for $PB_1$ in FIG. 5. The bolt assembly 122 and accompanying cam 116 move forward to an extent that cam 116 is out of engagement with cam follower 186, thus freeing pivot block 162 to return to the pivot-block open position in response to the urging of return spring 170. In this configuration, the paintball contact surface 212 and paintball stop surface 232 to return back to their respective open positions in contact with arm motion stop 246. With paintball contact surface 212 again in the contact-surface open position, the next paintball in sequence to load, paintball $PB_3$ in FIGS. 7 and 10, is now free to move down into loading chamber 54.

Figure 11:
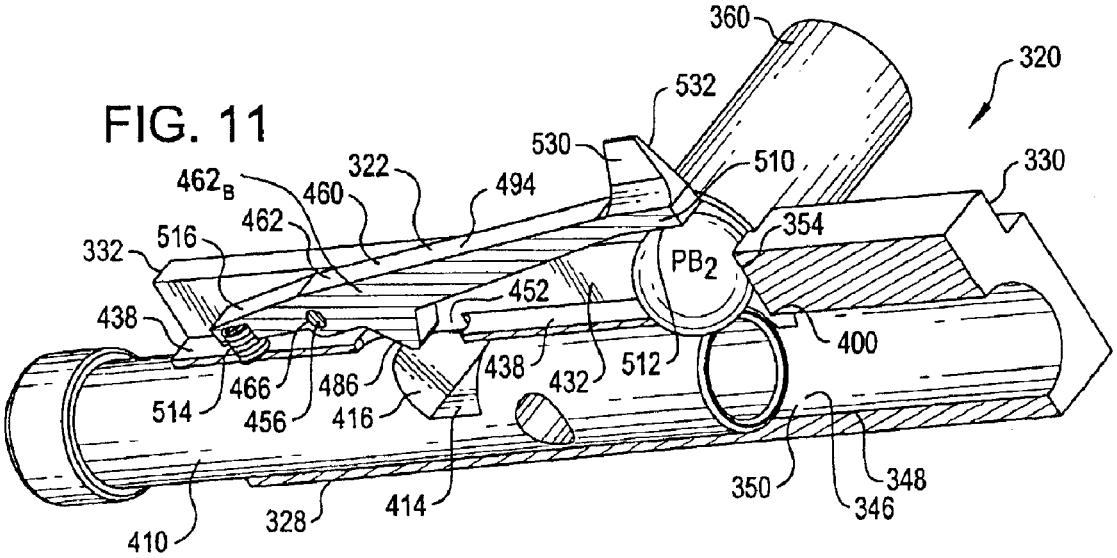
FIG. 11 is a partially cut away bottom perspective view of a portion of another embodiment of a loader for a closed-bolt paintball gun, which loader embodies principles of the present invention, illustrating in this embodiment the use of a loader with a rigid lever arm actuated by a push spring, and which limits force brought to bear against a paintball via spring force provided by the push spring with which the lever arm is actuated.
Figure 12:
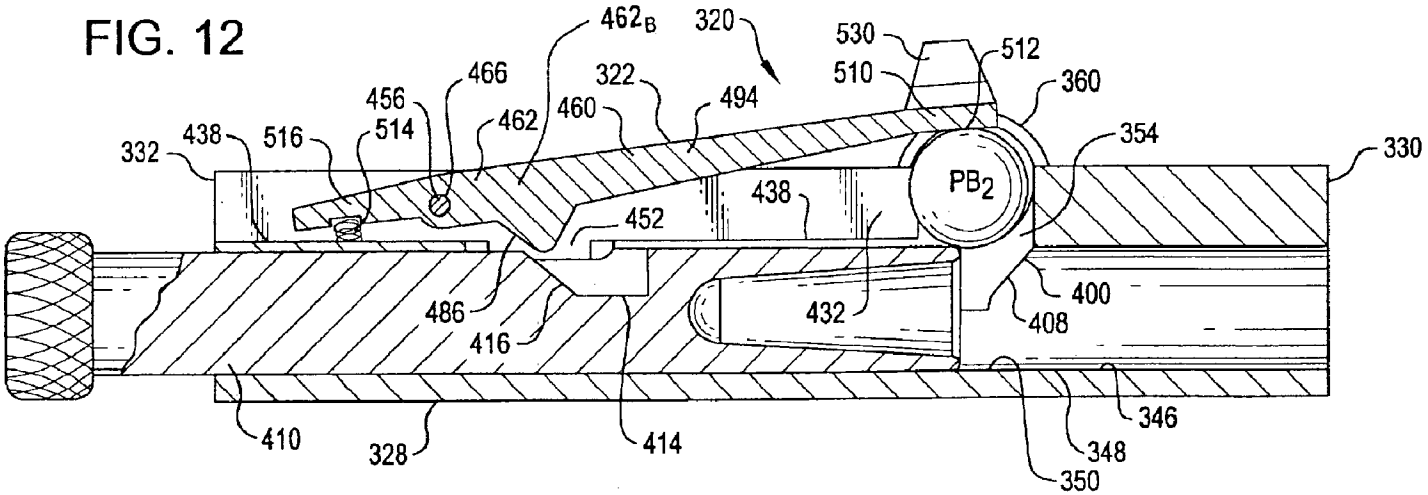
FIG. 12 is a horizontal cross-sectional view of the embodiment just illustrated in FIG. 11, taken looking up through the loading chamber of the paintball gun and the loader arm.

Attention is now directed to FIGS. 11 and 12, which provide cross sectional view looking up from the bottom at a portion of a closed-bolt paintball gun 320 which incorporates therein another embodiment of a paintball loader 322 which functions according to the teachings made herein. Loader 322 combines in a unitary loader structure a pivot block 462 pivotable at a pivot pin 456, a cam follower 486, and a substantially rigid lever arm 494 providing thereon both a paintball contact surface 512 and a paintball stop surface. A bolt assembly (not fully shown, but similar to the configuration described above) again includes a bolt 410. A cam 416 on the bolt 410 now faces forward, and the cam follower 486 now faces rearward and is located forward of the pivot pin 456. The cam 416 and cam follower 486 are now positioned and oriented so that, as the bolt 410 moves forward toward the bolt-closed position, the cam 416 and cam follower 486 engage and cause the pivot block 462 to rotate to the pivot-block open position. The loader 322 now includes a push spring 514 that urges the pivot block 462 toward the pivot-block loading position. When the gun 320 is fired and the bolt 410 moves rearward, the cam 416 and cam follower 486 disengage, allowing the push spring 514 to urge the pivot block 462 toward the pivot-block loading position, thus urging the paintball contact surface 512 toward the breech 350 and loading a paintball PB into the gun breech 350 in close synchronization with the cycling of the bolt assembly.

Gun 320 includes a gun frame 328, a portion of which is illustrated in FIGS. 11 and 12. Frame 328 has a forward end 330 and a rearward end 332. Extending longitudinally within gun 320 is a bolt chamber 346 defined by a bolt chamber sidewall 348. A breech portion 350 of bolt chamber 346 serves to receive and contain a just-loaded paintball PB.

Gun 320 has a loading chamber 354 located adjacent to and laterally outward from breech 350 for receiving and containing the next paintball to be loaded. Gun 320 has a paintball feed tube 360 affixed to frame 328 and in communication with loading chamber 354. Feed tube 360 sequentially receives paintballs from an external paintball supply hopper (not shown), and conducts them downward into loading chamber 354 to await loading. FIGS. 11 and 12 show, by way of example, a paintball $PB_2$ in loading chamber 354.

A loading port 400, defined by a loading port edge 408, penetrates bolt chamber sidewall 348 to provide communication between loading chamber 354 and breech 350. Loading port 400 when open accommodates the passage therethrough of a paintball as it is loaded from loading chamber 354 into breech 350.

Within bolt chamber 346 is a bolt 410. Provided on bolt 410 is a cam recess 414, having at the rear a forwardly directed cam 416. Bolt 410 is slidably translatable within bolt chamber 346, cycling therein when gun 320 is fired from a forward bolt-closed position where loading port 400 is closed by bolt 410, to a rearward bolt-open position where loading port 400 is open, and then returning forward to the bolt-closed position. When gun 320 is ready to fire, bolt 410 is in the forward bolt-closed position.

Extending rearwardly from loading chamber 354 on the exterior of gun frame 328 is a loader mounting slot 432 having an inner slot wall 438. Penetrating through inner wall 438 to provide access to bolt chamber 346 is a bolt access opening 452. A pivot pin 456 is removably fixed to gun frame 328.

Loader 322 includes a substantially rigid unitary loader structure 460. Structure 460 includes a pivot block portion 462 penetrated by a pivot pin bore 466, and a lever arm portion 494 extending from pivot block 462. Lever arm 494 has a distal portion 510, providing thereon a paintball contact surface 512 engageable on a paintball $PB_2$ in loading chamber 354.

Pivot pin 456 fits through bore 466 in a manner that permits pivot block 462 to securely rotate in an oscillating fashion on gun 320, moving counterclockwise (as viewed from below) to reach a pivot-block open position, and moving clockwise to reach a pivot-block loading position.

Lever arm 494 extends from pivot block 462 toward loading chamber 354 to place paintball contact surface 512 in a position to be engageable on paintball $PB_2$ in loading chamber 354. When pivot block 462 is in the pivot-block open position, paintball contact surface 512 is outward in a contact-surface open position.

Lever arm 494 operates as a lever to urge a paintball from loading chamber 354 and toward breech 350 as pivot block 462 rotates in response to rearward translation of bolt 410. Lever arm 494 extends forward from the main body portion $462_B$ of pivot block 462, so rotation of pivot block 462 toward the pivot-block loading position causes paintball contact surface 512 on lever arm 494 to be urged inward, toward breech 350.

The size and shape of paintball contact surface 512, the mounting of pivot block 462 to gun frame 328, and the extension of lever arm 494 from the main body portion $462_B$ of the pivot block 462 toward loading chamber 354 to position paintball contact surface 512 are mutually established to achieve and/or optimize two design objectives. First, when paintball contact surface 512 is in the contact-surface open position, sufficient space S is provided between paintball contact surface 512 and breech 350 for accommodating the entrance of a paintball into loading chamber 354 from feed tube 360. Second, as pivot block 462 pivots to the pivot block loading position, paintball contact surface 512 is able to engage the paintball in loading chamber 354, and to urge the paintball toward and into breech 350. In FIGS. 11 and 12 the next paintball to be loaded into breech 350, paintball $PB_2$, now resides in loading chamber 354, awaiting engagement by paintball contact surface 512.

Loader 322 includes a push spring 514. Push spring 514 is captive between a rearward portion 516 of pivot block 462 and inner slot wall 438. Push spring 514 serves to urge rearward portion 516 of pivot block 462 away from wall 438, thereby urging pivot block 462 to rotate clockwise toward the pivot-block loading position, and paintball contact surface 512 to move toward breech 350.

A rearwardly-directed cam follower portion 486 of pivot block 462 extends inward to fit through bolt access opening 452. As bolt 410 translates forward, cam follower 486 engages and is urged outward by bolt cam 416. As bolt 410 translates rearward, the cam follower 486 disengages from cam 416 and is urged inward by push spring 514. In this embodiment cam follower 486 is forward of pivot pin bore 466, so that pivot block 462 and paintball contact surface 512 rotate counterclockwise as cam follower 486 moves outward, and clockwise as cam follower 486 moves inward.

Pivot block 462 and paintball contact surface 512 are thus seen to oscillate cyclically angularly in response to the cycling of bolt 410 when gun 320 is fired. When gun 320 is ready to fire, bolt 410 is in the bolt-closed position, and cam 416 and cam follower 486 are engaged, causing pivot block 462 and paintball contact surface 512 to be in their respective open positions. When gun 320 is fired bolt 410 moves rearward toward the bolt-open position. In response, cam 416 and cam follower 486 disengage, allowing push spring 514 to move pivot block 462 toward the pivot-block loading position, and paintball contact surface 512 to move inward toward breech 350, to engage a paintball in loading chamber 354 and then urge the paintball into breech 350. Then, as bolt 410 returns forward to the bolt-closed position, pivot block 462 and paintball contact surface 512 are returned to their respective open positions, permitting the next paintball to be loaded to move into loading chamber 354, in position to be loaded the next time gun 320 cycles.

When paintball contact surface 512 moves inward toward breech 350 to load a paintball, occasionally the paintball to be loaded may not have moved far enough into loading chamber 354 that it is in position to be pushed through loading port 400. If the paintball is not in far enough, the paintball may be jammed against some portion of gun frame 328 or feed tube 360 by the moving contact surface 512, as was illustrated previously for loader 22 in FIG. 10A. Also, the locations and dimensions of the elements making up loader 322, and the location of cam 416 on bolt 410, can be adjusted so that paintball contact surface 512 urges a paintball toward breech 350 before loading port 400 is fully open, similar to the configuration and in principle basically as was illustrated previously for loader 22 in FIG. 6.

In one embodiment, the cam 416, the cam follower 486, pivot block 462, and lever arm 494 are sized, shaped, and positioned, and push spring 514 is provided with an appropriate spring force, so that paintball contact surface 512 exerts a force that is (1) sufficiently large, if a paintball is in position to move through loading port 400, to move the paintball through loading port 400 during the period of time bolt 410 is rearward and loading port 400 is open, and (2) not so large as to damage the paintball in the event that the paintball jams, or is urged toward breech 350 before loading port 400 fully opens.

In one embodiment, extending generally outward from distal portion 510 of lever arm 494 is a paintball stop tab 530 having an upwardly directed paintball stop surface 532. Paintball stop surface 532 is sized, shaped, and positioned on lever arm 494 so that when paintball contact surface 512 moves toward breech 350, paintball stop surface 532 is engageable with a paintball moving from feed tube 360 into loading chamber 354. This configuration allows stop surface 532 to prevent an entering paintball from moving far enough into loading chamber 354 to interfere with the subsequent return of paintball contact surface 512 outward to toward the contact-surface open position. Thus, ball stop tab 530 and ball stop surface 532, beneficially serve to reduce the chance that a paintball moving into loading chamber 354 will prevent the return of paintball contact surface 512 to the contact-surface open position after loading a paintball into breech 350.

Operation of loader 322 is closely analogous to operation of loader 22, with the loader pivot block 462 and paintball contact surface 512 again moving cyclically angularly in response to the cycling of the gun bolt 410 when the gun is fired. Given the designs illustrated herein, the movement of the paintball contact surface in this embodiment, as well as in previous embodiments, is oscillatory. Further, the directional relationships are the same as for loader 22. That is, the pivot block 462 and the paintball contact surface 512 again move to load a paintball into the gun breech 350 in response to bolt 410 movement rearward, and the pivot block 462 and the paintball contact surface 512 again move to permit another paintball to enter the gun loading chamber in response to bolt 410 movement forward. Limitation of the force with which a paintball is urged toward the breech 350, and the storage of energy to start moving the paintball through the gun loading port as soon as it is open, is again provided, now by push spring 514 rather than by spring arm portion 220 of lever arm 194.

The present invention further provides methods for loading individual paintballs into a closed-bolt paintball gun using the loaders described herein. In a first method, a loader having a reciprocating paintball contact surface is provided. A cam follower on the loader is engageable with a cam on the gun bolt assembly, thereby causing the paintball contact surface to move reciprocally, first toward the gun breech from a contact-surface open position, and then back to the contact-surface open position, in response to the translation cycle of the gun bolt assembly when the gun is fired. The paintball contact surface is shaped, sized, mounted, and positioned to allow a paintball into the gun loading chamber when in the contact-surface open position, and when moving toward the gun breech, to be engageable on the paintball in the gun loading chamber, and to then urge the paintball from the loading chamber into the breech. The paintball contact surface is provided on a flexible elastic lever arm that serves to limit the force exerted on the paintball as it is urged from the loading chamber into the breech. A separate stop arm serves to prevent a paintball entering the loading chamber from interfering with the paintball contact surface moving back to the contact-surface open position.

In other methods provided by the invention, a paintball loader is provided with a substantially rigid unitary loader structure, and a push spring which provides limited spring force against a paintball as it is urged from the loading chamber into the breech, so that a paintball will not tend to be broken, even when the gun jams.

The foregoing embodiments show in one instance a loader with a separable flexible lever arm and a ball stop surface provided on a separable stop arm, and in a second instance a loader of unitary structure with a rigid lever arm and a ball stop surface on a tab affixed to the rigid lever arm. However, to practice the invention set forth herein a variety of other combinations are possible and will be apparent to one of ordinary skill in the art, including by way of example but not limitation a loader of unitary structure with a flexible lever arm that incorporates thereon a stop tab providing a ball stop surface, and a loader with a rigid lever arm that incorporates a separable stop arm It can be seen from the foregoing that as the gun cycles, the loader moves in response to, and in close synchronization with, the movement of a gun bolt, and more generally, the movement of a gun bolt assembly. In one embodiment, a planar surface for the bolt cam and a curved surface for cam follower are illustrated. However, it will be understood by one skilled in the art and to whom this specification is directed, that to practice the invention set forth herein many surface configurations are suitable for the required cam engagement mechanism to provide that cyclic translation of the gun bolt assembly results in oscillatory rotation of the loader pivot block in response.

While the present invention has been particularly described herein as utilizing engagement of a loader pivot block with a bolt, or more precisely, a cam follower on a pivot block with a cam on a bolt, to provide the energy to load a paintball, the energy may more generally be obtained from any portion of the bolt assembly. Further, the cam on the bolt or bolt assembly can be located elsewhere along bolt or bolt assembly to thereby change the timing of the motion of the paintball contact surface to urge a paintball toward the gun breech, relative to time at which the loading port is opened by the rearward motion of the bolt assembly.

It is to be appreciated that the various aspects and embodiments of a paintball loader moving reciprocally in response the movement of a bolt or bolt assembly, and the method of utilizing such an apparatus, are an important improvement in the state of the art of loaders for closed-bolt paintball guns. The loader components described herein are simple, robust, reliable, and susceptible to application in various configurations. Although only a few exemplary embodiments have been described in detail, various details are sufficiently set forth in the drawing figures and in the specification provided herein to enable one of ordinary skill in the art to make and use the invention(s), which need not be further described by additional writing in this detailed description.

Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention (s) may be practiced otherwise than as specifically described herein. Thus, the scope of the invention(s), as set forth in the appended claims, and as indicated by the drawing figures and by the foregoing description, is intended to include variations from the embodiments provided which are nevertheless described by the broad interpretation and range properly afforded to the plain meaning of the claims set forth below.

What is claimed is:

1. A paintball loader in combination with a paintball gun, said gun having a loading chamber and a breech;

said loader for individually urging paintballs from said loading chamber into said breech as said gun cycles;

said loader comprising an oscillating paintball contact surface;

said paintball contact surface residing in a contact-surface open position when said paintball gun is ready to fire;

said paintball contact surface oscillatably movable, in response to the cycling of said gun, from said contact-surface open position toward said breech, and then back to said contact-surface open position;

said paintball contact surface shaped, sized, mounted and positioned to provide space between said breech and said paintball contact surface for accommodating the movement of a paintball into said loading chamber when said paintball contact surface is in said contact-surface open position, and in response to the cycling of said gun (i) to engage and urge the paintball into said breech as said paintball contact surface moves toward said breech, and (ii) to return to said contact-surface open position.

2. A paintball loader for incorporation into a closed-bolt paintball gun, said gun having a loading chamber, a breech, a loading port and a bolt assembly;

said loading chamber adjacent to and outward from said breech;

said bolt assembly cycling when said gun fires;

said bolt assembly moving reciprocally when cycling, from a bolt-closed position whereat said loading port is closed and said gun is ready to fire, to a bolt-open position whereat said loading port is open, and then returning to said bolt-closed position;

said loader for individually urging paintballs from said loading chamber, through said loading port, and into said breech, while said loading port is open;

said paintball loader comprising and oscillating paintball contact surface;

said paintball contact surface oscillatably movable in response to the cycling of said bolt assembly and shaped, sized, mounted and positioned to:

(i) reside in a contact-surface open position whereat space is provided between said breech and said paintball contact surface for accommodating the movement of a paintball into said loading chamber when said bolt assembly is in said bolt-closed position; and (ii) move through said loading chamber toward said breech to engage the paintball and to urge the paintball into said breech in response to said bolt assembly moving to said bolt-open position, (iii) return back to the contact surface open position in response to said bolt assembly returning to said bolt-closed position.

3. A closed-bolt paintball gun, said gun comprising:

(a) a loading chamber, (b) a breech, (c) a loading port, said loading chamber adjacent to and outward from said breech, (d) a bolt assembly, said bolt assembly comprising a bolt, said bolt assembly residing, when said gun is ready to fire, in a bolt-closed position whereat said loading port is closed, said bolt assembly cycling when said gun fires between said bolt-closed position, and a bolt-open position whereat said loading port is open, (e) a paintball loader for individually urging paintballs from said loading chamber into said breech as said bolt assembly cycles;

said paintball loader comprising:

(1) an oscillatably movable pivot block, said pivot block pivotably mounted to said paintball gun;

(2) a lever arm, said lever arm comprising a paintball contact surface thereon, said lever arm extending from said pivot block to place said paintball contact surface in a position to be movable inward and outward through said loading chamber as said pivot block moves, said pivot block residing, when said gun is ready to fire, in a pivot-block open position whereat said paintball contact surface resides in a contact-surface open position which provides space between said breech and said paintball contact surface to accommodate the movement of a paintball into said loading chamber, said pivot block moving, in response to said bolt assembly cycling, from said pivot-block open position to a pivot-block loading position, thus moving said paintball contact surface inward to engage and urge said paintball into said breech, and then back to said pivot-block open position.

4. The apparatus as set forth in claim 3, wherein said lever arm further comprises a paintball stop tab.

5. The apparatus as set forth in claim 3, wherein said lever arm is separable from, and removably attachable to, said pivot block.

6. The apparatus as set forth in claim 3, wherein said lever arm and said pivot block are of unitary construction.

7. A closed-bolt paintball gun, said gun comprising:

(a) a loading chamber, (b) a breech, (c) a loading port, said loading chamber adjacent to and outward from said breech, (d) a bolt assembly, said bolt assembly comprising a cam, said bolt assembly residing, when said gun is ready to fire, in a bolt-closed position whereat said loading port is closed, said bolt assembly cycling when said gun fires between said bolt-closed position, and a bolt-open position whereat said loading port is open, (e) a paintball loader for individually urging paintballs from said loading chamber into said breech as said bolt assembly cycles;

said paintball loader comprising:

(1) an oscillatably movable pivot block, said pivot block pivotably mounted to said paintball gun;

said pivot block comprising a cam follower, said cam and said cam follower engageable as said bolt assembly cycles, said pivot block moving in response to the engagement of said cam and said cam follower, (2) a lever arm, said lever arm comprising a paintball contact surface thereon, said lever arm extending from said pivot block to place said paintball contact surface in a position to be movable inward and outward through said loading chamber as said pivot block moves, said pivot block residing, when said gun is ready to fire, in a pivot-block open position whereat said paintball contact surface resides in a contact-surface open position which provides space between said breech and said paintball contact surface to accommodate the movement of a paintball into said loading chamber, said pivot block moving, in response to said bolt assembly cycling, from said pivot-block open position to a pivot-block loading position, thus moving said paintball contact surface inward to engage and urge said paintball into said breech, and then back to said pivot-block open position.

8. The apparatus as set forth in claim 7, wherein said lever arm further comprises a paintball stop tab.

9. The apparatus as set forth in claim 7, wherein said lever arm is separable from, and removably attachable to, said pivot block.

10. The apparatus as set forth in claim 7, wherein said lever arm and said pivot block are of unitary construction.

11. The apparatus as set forth in claim 7, wherein said bolt assembly further comprises a forwardly directed cam;

said pivot block further comprises a rotation axis and a rearwardly directed cam follower, said loader further comprises a push spring for urging said pivot block toward said pivot-block loading position, said pivot block pivoting around said rotation axis, said cam follower located forward of said rotation axis, said cam and said cam follower engageable as said bolt assembly moves forward, said cam follower moving outward, in response to the engagement of said cam and said cam follower, for moving said pivot block to a pivot-block open position.

12. The apparatus as set forth in claim 11, wherein said gun further has a stop boss and said loader further comprises a stop arm.

13. A closed-bolt paintball gun, said gun comprising:

(a) a forward end, (b) a rearward end, (c) a loading chamber, (d) a breech, (e) a loading port, said loading chamber adjacent to and outward from said breech, (f) a bolt assembly, said bolt assembly comprising a rearwardly directed cam, said bolt assembly residing, when said gun is ready to fire, in a bolt-closed position whereat said loading port is closed, said bolt assembly cycling when said gun fires between said bolt-closed position, and a bolt-open position whereat said loading port is open, said bolt-closed position located forward of said bolt-open position, (g) a paintball loader for individually urging paintballs from said loading chamber into said breech as said bolt assembly cycles, said paintball loader comprising an oscillatably movable pivot block and a lever arm, said pivot block comprising a rotation axis and a forwardly directed cam follower, said pivot block mounted to said paintball gun to pivot around said rotation axis, said lever arm comprising a paintball contact surface thereon and a flexible elastic spring portion, said lever arm extending forward from said pivot block to place said paintball contact surface in a position to be movable inward and outward through said loading chamber as said pivot block moves, said elastic spring portion located between said pivot block and said paintball contact surface, said pivot block residing, when said bolt is in said bolt-closed position, in a pivot-block open position whereat said paintball contact surface resides in a contact-surface open position which provides space between said breech and said paintball contact surface to accommodate the movement of a paintball into said loading chamber, said cam follower located rearward of said rotation axis, said cam and said cam follower engageable as said bolt assembly moves rearward, said cam follower moving outward, in response to the engagement of said cam and said cam follower, for moving said pivot block to a pivot-block loading position, and for moving said paintball contact surface inward to engage and urge said paintball into said breech.

said loader further comprising a return spring for urging said pivot block toward said pivot-block open position.

14. The apparatus as set forth in claim 13, wherein said lever arm further comprises a paintball stop tab.

15. The apparatus as set forth in claim 13, wherein said lever arm is separable from, and removably attachable to, said pivot block.

16. The apparatus as set forth in claim 13, wherein said lever arm and said pivot block are of unitary construction.

17. The apparatus as set forth in claim 13, wherein said elastic spring portion is sized, shaped, and composed of a material selected to provide a spring force sufficient to ensure the paintball is urged by said paintball contact surface from said loading chamber into said breech while said bolt assembly is in said bolt-open position, and not so great as to cause said paintball contact surface to damage the paintball.

18. A method of loading a paintball into a closed-bolt paintball gun, said gun having a loading chamber and a breech, said loading chamber for holding a paintball to be loaded, said breech for receiving the paintball from said loading chamber as said paintball gun cycles, said method comprising:

(a) providing a paintball loader, said loader comprising a oscillating paintball contact surface, said paintball contact surface residing in a contact-surface open position when said paintball gun is ready to fire;

said paintball contact surface oscillatably movable, in response to the cycling of said gun, from said contact-surface open position toward said breech, and then back to said contact-surface open position;

said paintball contact surface shaped, sized, mounted and positioned (i) to provide space between said breech and said paintball contact surface for accommodating the movement of a paintball into said loading chamber when said paintball contact surface is in said contact-surface open position, and (ii) to engage and urge the paintball into said breech as said paintball contact surface moves toward said breech, and (iii) to again provide space between said breech and said paintball contact surface for accommodating the entrance of another paintball into said loading chamber when said paintball contact surface moves back to said contact-surface open position;

(b) introducing a paintball to be loaded into said loading chamber;

(c) initiating the cycling of said gun;

(d) moving said paintball contact surface from said contact-surface-open position toward said breech as said gun cycles;

(E) engaging with said paintball contact surface the paintball in said loading chamber;

(F) urging the paintball toward and into said breech;

(G) returning said paintball contact surface back to said contact-surface-open position as said gun continues to cycle;

(H) introducing a next paintball into said loading chamber.

* * * * *